US010549966B2

(12) United States Patent
Ziebell

(10) Patent No.: US 10,549,966 B2
(45) Date of Patent: Feb. 4, 2020

(54) ADJUSTABLE ROLLER SYSTEM FOR ROPE RESCUES AND ROPE CLIMBING

(71) Applicant: John A. Ziebell, Hubbard, IA (US)

(72) Inventor: John A. Ziebell, Hubbard, IA (US)

( * ) Notice: Subject to any disclaimer, the term of this patent is extended or adjusted under 35 U.S.C. 154(b) by 17 days.

(21) Appl. No.: 16/036,507

(22) Filed: Jul. 16, 2018

(65) Prior Publication Data

US 2019/0023541 A1 Jan. 24, 2019

Related U.S. Application Data

(60) Provisional application No. 62/533,892, filed on Jul. 18, 2017.

(51) Int. Cl.
*B66D 1/36* (2006.01)
*A62B 1/18* (2006.01)

(52) U.S. Cl.
CPC ..... *B66D 1/36* (2013.01); *A62B 1/18* (2013.01); *B66D 2700/028* (2013.01)

(58) Field of Classification Search
CPC ..... B66D 1/36; B66D 2700/028; B66D 2700/026; B66D 3/06; B66D 3/04; A62B 1/18; F16H 55/36; H02G 1/04
See application file for complete search history.

(56) References Cited

U.S. PATENT DOCUMENTS 3,145,016 A * 8/1964 Leithiser, Jr. ..... H02G 1/04 254/134.3 R
3,286,863 A * 11/1966 Thompson ..... B66C 3/02 414/624
3,828,602 A * 8/1974 Leithiser ..... B21D 7/06 72/383
3,863,897 A * 2/1975 Yeager ..... H02G 1/04 254/134.3 R
4,417,718 A * 11/1983 Niskin ..... B66D 3/06 254/394
5,149,059 A * 9/1992 Monahan ..... B63B 21/10 254/394
5,992,827 A * 11/1999 Kvalsund ..... B63B 21/66 254/398
9,751,715 B2 * 9/2017 Cooper ..... B23K 9/122
2012/0137527 A1 * 6/2012 Huang ..... A01G 3/0251 30/185

* cited by examiner

*Primary Examiner* — Michael E Gallion
(74) *Attorney, Agent, or Firm* — McKee, Voorhees & Sease, PLC

(57) ABSTRACT

A rope guide is provided for use in rope rescues and rope climbing. The guide includes a frame comprised of two legs, pivotally connected at the inner ends so that the outer ends can be adjusted between substantially open and substantially closed positions. A lock pin secures the frame in a selected pivotal position. The mouth of the frame between the outer ends of the legs can be positioned over an object, such as a rail, a building edge, or a rock so as to protect the rope from contact with such objects.

14 Claims, 13 Drawing Sheets

ADJUSTABLE ROLLER SYSTEM FOR ROPE RESCUES AND ROPE CLIMBING

CROSS-REFERENCE TO RELATED APPLICATION

This application claims priority to U.S. provisional application Ser. No. 62/533,892, filed Jul. 18, 2017, which is herein incorporated by reference in its entirety.

BACKGROUND OF THE INVENTION

Rope rescues, as well as rope climbing, often require the rope to pass over objects or obstacles, such as hand rails, guard rails, concrete barriers, and other structures which may damage the rope. Ideally, the rope should not be moved across any stationery objects, which creates friction, and may cut strands of the rope, thereby weakening the rope and decreasing its normal life expectancy. For maximum safety and useful life, ropes should only pass over rollers, which minimize friction.

Prior art rope rollers are known, but typically are not adjustable. Therefore, it is necessary to have multiple sets of rollers to accommodate different size objects. The need for multiple sets of rollers increases cost to fire departments, rescue units, and other users who encounter various rope rescues and climbing situations.

Therefore, a primary objective of the present invention is the provision of an adjustable roller system for rope rescues and climbing.

A further objective of the present invention is the provision of a single roller system which can fit over various size and shape obstacles for use during a rope rescue and rope climbing.

Still another objective of the present invention is the provision of an adjustable rope roller assembly which is economical to manufacture, and durable and safe in use.

Another objective of the present invention is a provision of a rope guide having a frame with rollers over which the rope moves to protect the rope from damage and excessive wear.

Another objective of the present invention is the provision of an adjustable rope guide having a pivotable frame which can be opened and closed to adjust the size of the mouth between the ends of the frame.

A further objective of the present invention is the provision of adjustable roller assembly having left and right frames pivotally connected together at inner ends and having outer ends which can be moved toward or away from it one another so that the assembly can be used on various sized objects encountered during rope rescues and rope climbing.

Still another objective of the present invention is the provision of an adjustable roller assembly which can be positioned in one of numerous positions between nearly closed and wide open.

These and other objections will become apparent from following description of the invention.

SUMMARY OF THE INVENTION

Figure 1B:
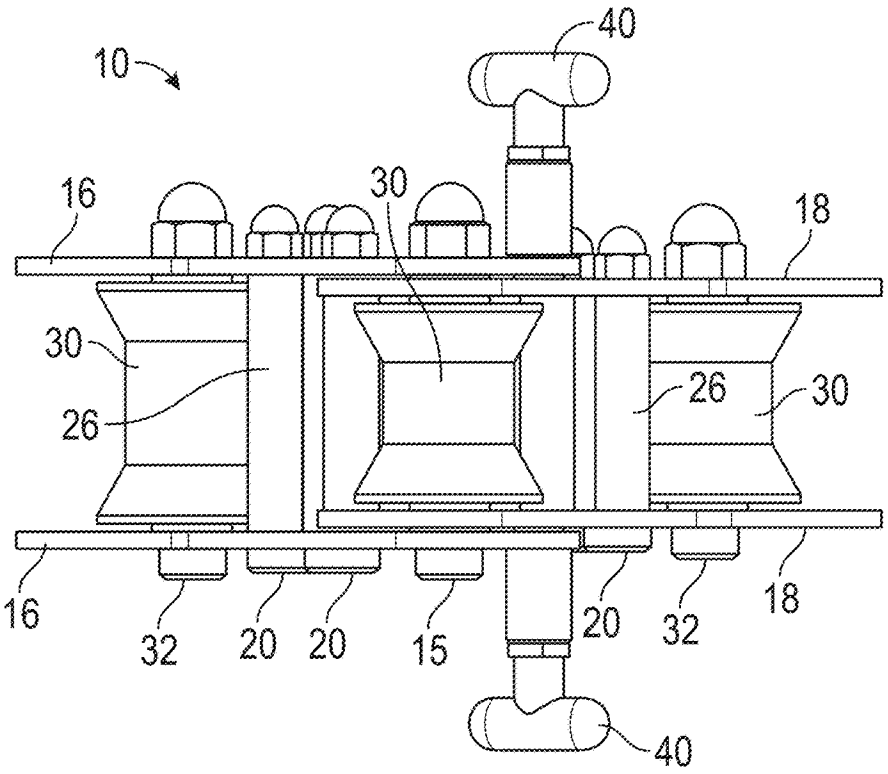
FIGS. 1A, B, C, and D show a perspective view, a top view, a side view, and an end elevation view, respectfully, of the adjustable roller system in a closed position, for example for use on a hand or small diameter guard rail.

The adjustable rope guide system or assembly includes an articulating frame pivotal about a center point and having opposite ends which can be spaced closely together or widely apart. A lock pin can be selectively inserted through one of a series of holes in the frame to lock the frame in a desired position to accommodate an object received in the mouth of the frame. Rollers extend between opposite sides of the frame. A rescue or climbing rope can be moved along the rollers safely, and without damage or wear. This rope guide can be used with various types and sizes of structures which may be encountered during rope rescues and/or rope climbing, and prevents the rope from contacting such structures, which can damage or cut the rope.

DETAILED DESCRIPTION OF THE INVENTION

The adjustable roller system or assembly of the present invention is generally designated in the drawings by the reference numeral 10. The system 10 includes an articulating frame having opposing legs 12, 14 pivotally connected at their inner ends by a central axle or bolt 15. The leg 12 is formed with a pair of spaced apart plates 16, and the leg 14 is formed by a pair of spaced apart plates 18. Each pair of plates 16 and 18 are pinned or bolted together by a series of bolts 20 and nuts 24. The free ends of the plates 16, 18 define a mouth M which can be opened and closed to varying degrees, as described below. Preferably, spacers 26, are provided on each of the bolts 20, between the respective plates 16, 18. As an alternative to the spacers 26, shoulder bolts can be used to connect the plates 16 and the plates 18.

Rollers 30 are mounted on the central bolt 15 and on at least one bolt or axle 32 of each leg 12, 14. Bushings 34 and washers 36 are provided on the opposite ends of each roller 30, and mount on the bolt axles 32. Preferably, all the bolts 15, 20, 32, are made of harden steel, while the plates are made of non-rust material, such as aluminum. The spacers 26 prevent the moving parts from galling.

The legs 12, 14 are pivotally locked utilizing a pair of pin bolts 38 which extend through aligned holes on the mating ends of the plates. A handle 40 is provided on the outer end of each pin bolt 38. A keeper 42 is threaded into the legs 12, 14, with a spring 44 mounted on the pin bolt 38 and within a bushing 46 on the leg 12. The inner end of each pin bolt 38 is selectively received within one of a series of holes 48A-F extending in an arc in the plates 18 of the leg 14. In the drawings, there are six holes 48A-F shown in the plates 18, though more or less holes may be utilized. As an alternative to the pin bolts 38, other types of locking mechanisms can be used to lock the frame legs 12, 14 in a selected pivoted orientation.

Figure 1A:
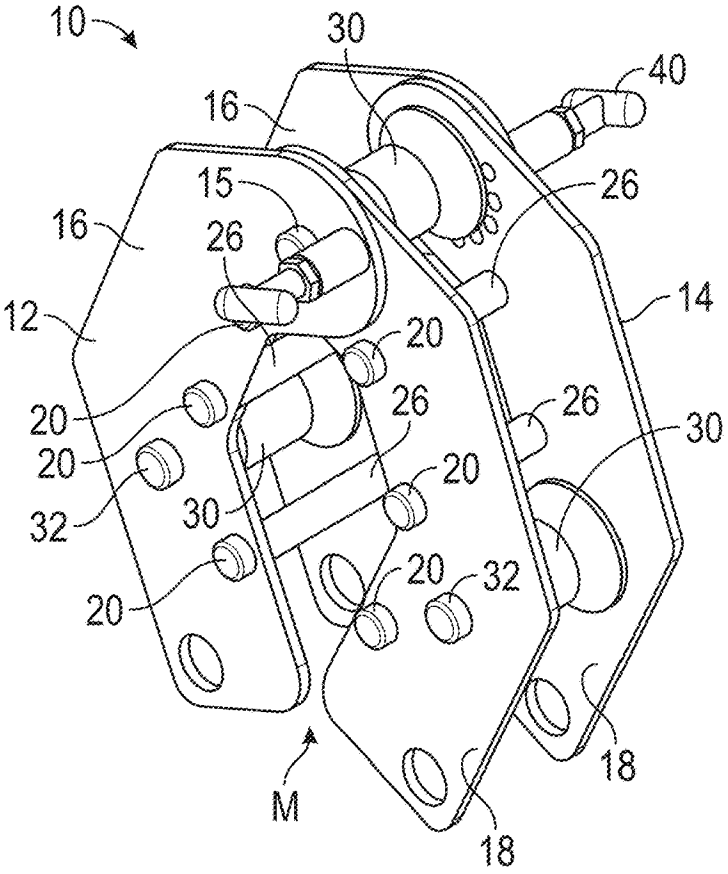
Figure 1C:
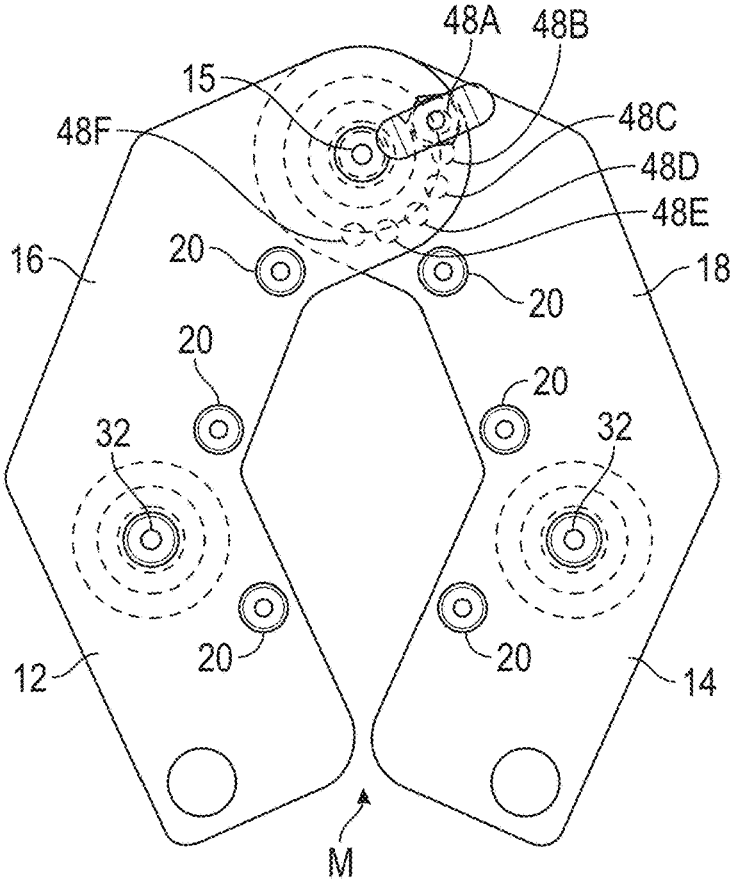
Figure 1D:
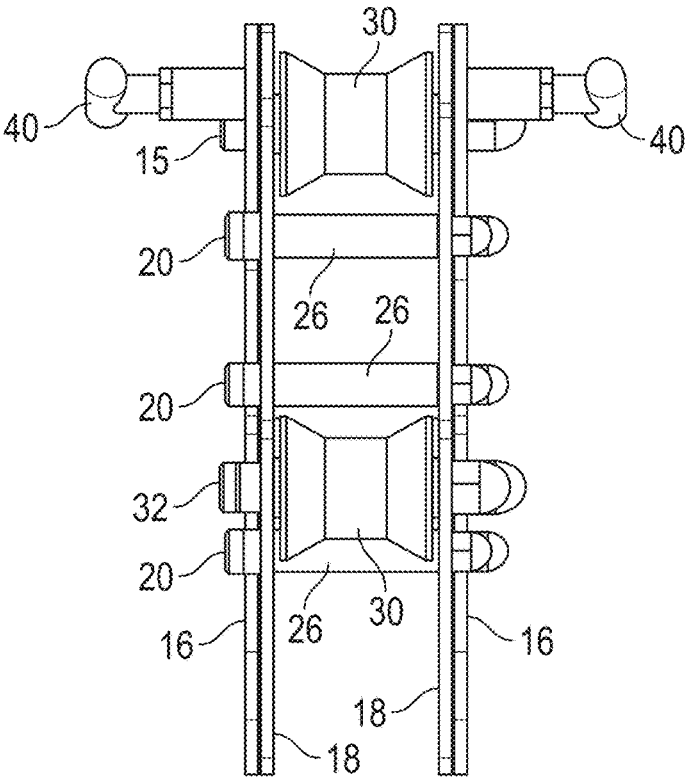
Figure 2A:
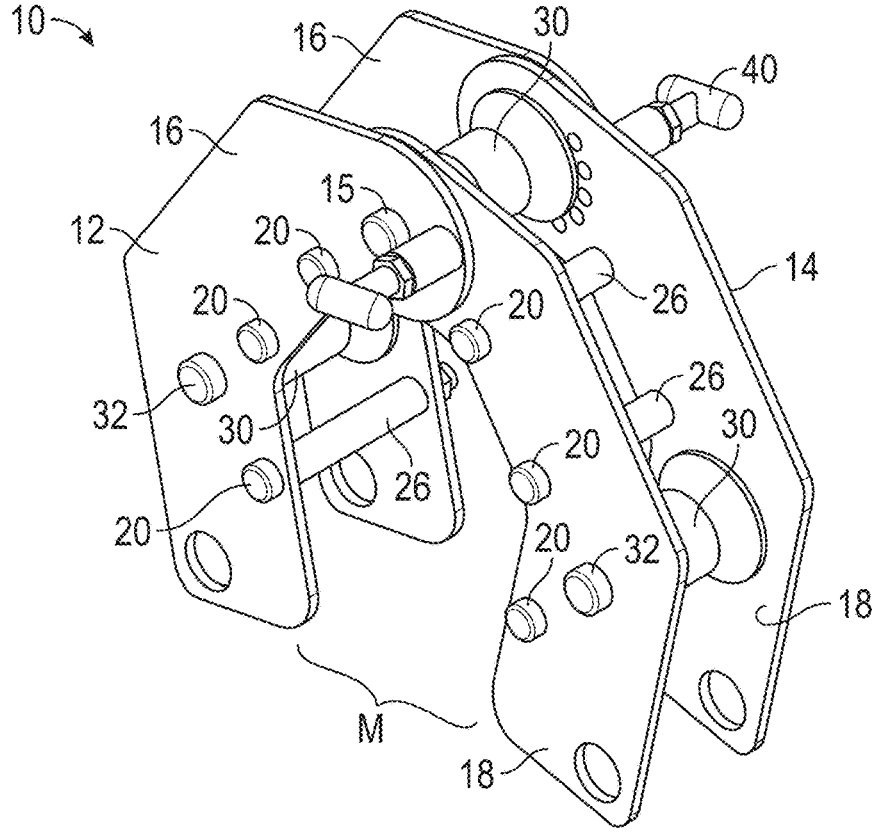
FIGS. 2A, B, C, and D are used similar to FIGS. 1A-1D, respectfully, showing the adjustable roller system in a second slightly opened position.
Figure 2B:
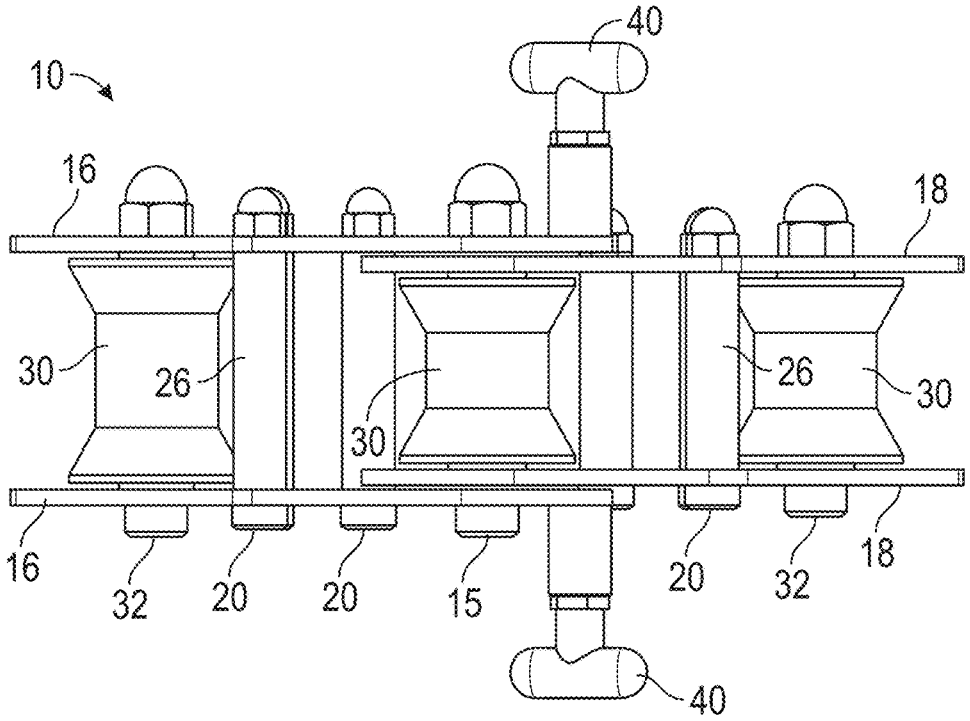
Figure 2C:
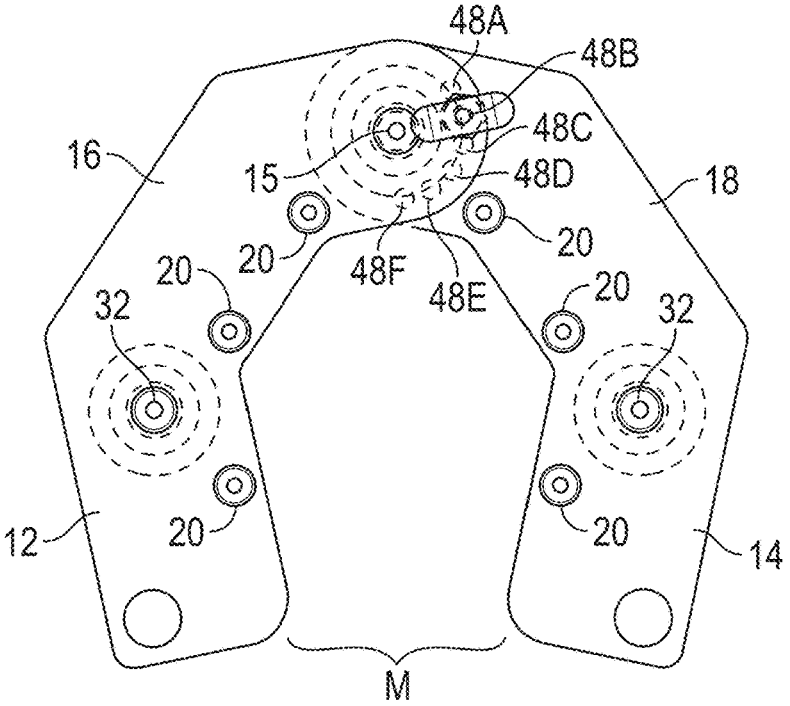
Figure 2D:
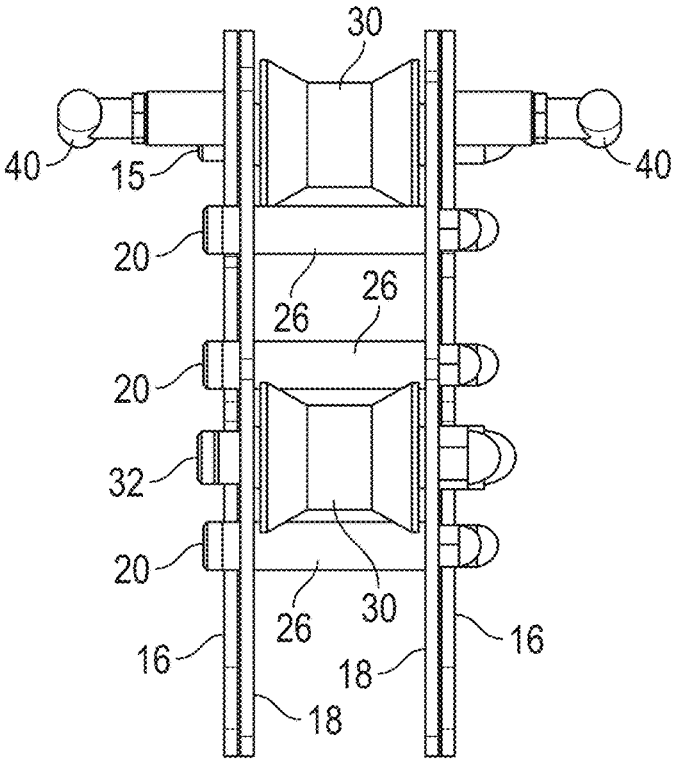
Figure 3A:
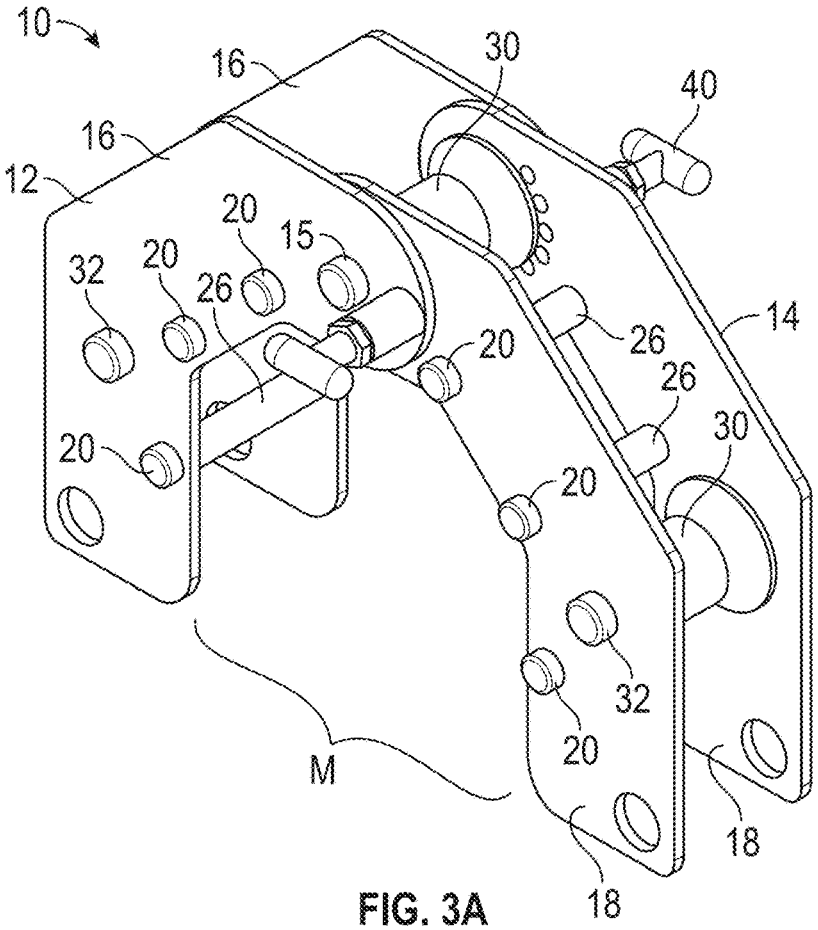
FIGS. 3A, B, C, and D are views similar to FIGS. 2A-2D, respectfully, showing the adjustable roller system in a third position opened approximately half way.
Figure 3B:
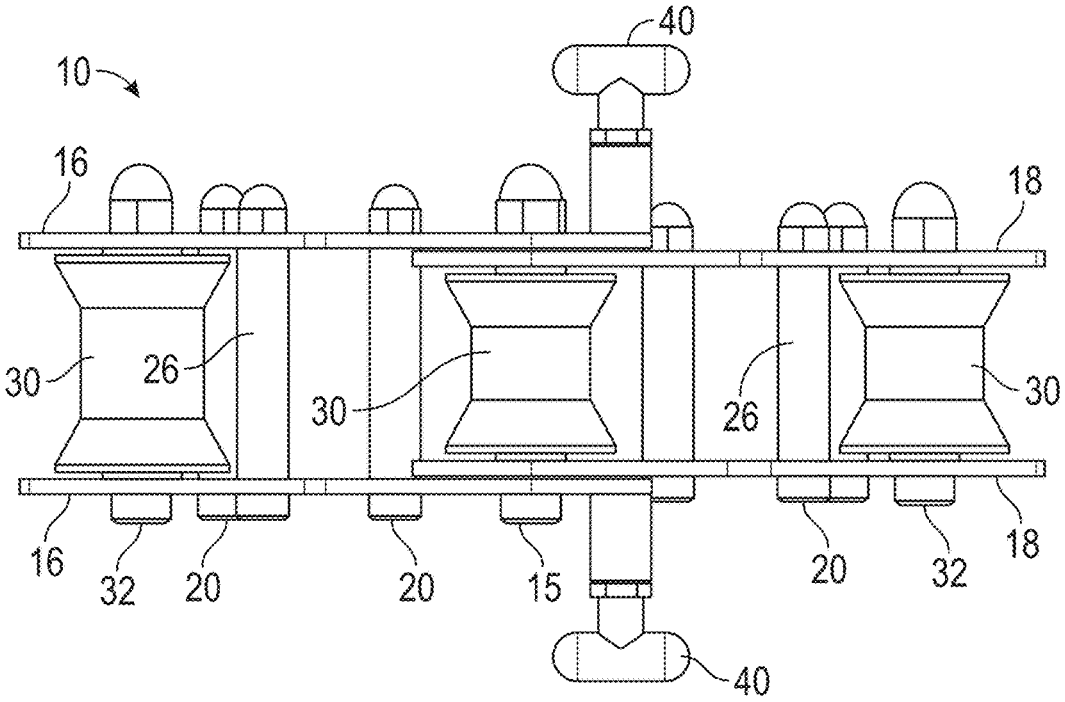
Figure 3C:
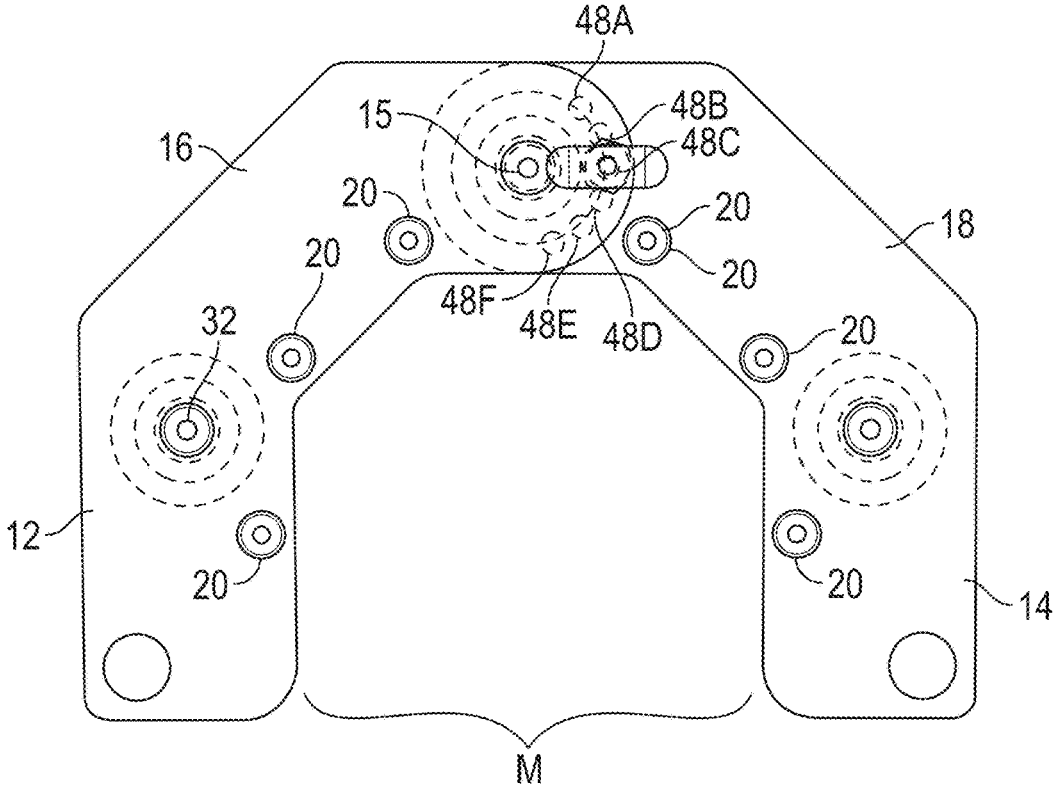
Figure 3D:
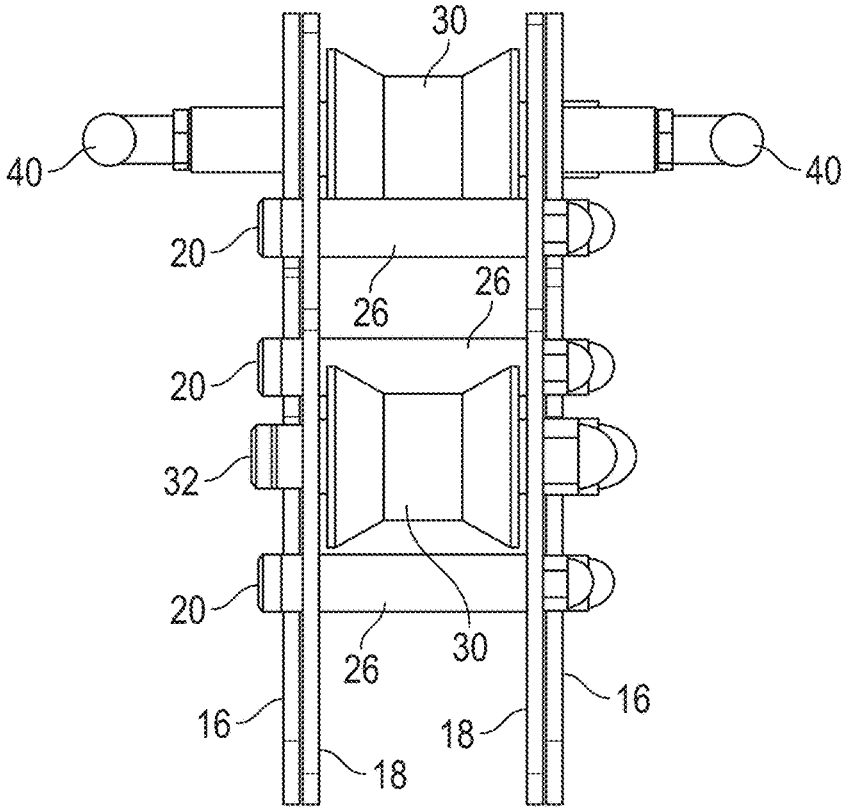
Figure 4A:
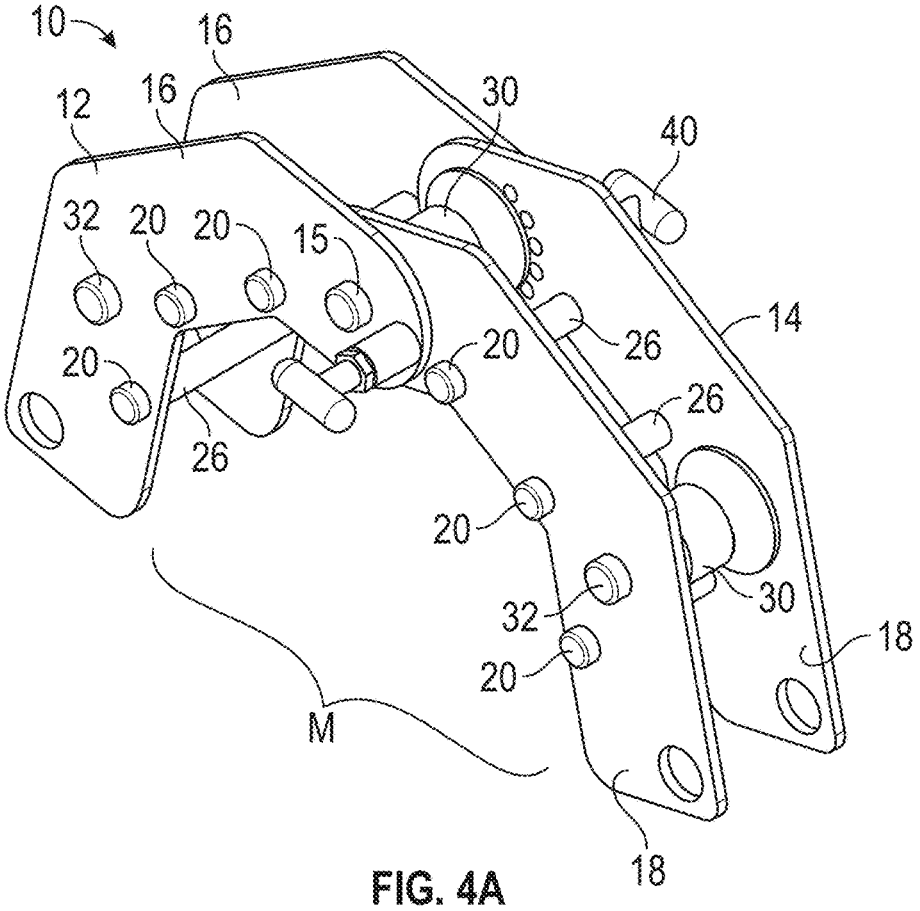
FIGS. 4A, B, C, and D, are another set of drawings similar to FIGS. 3A-3D respectfully, showing the system opened further to a fourth position.
Figure 4B:
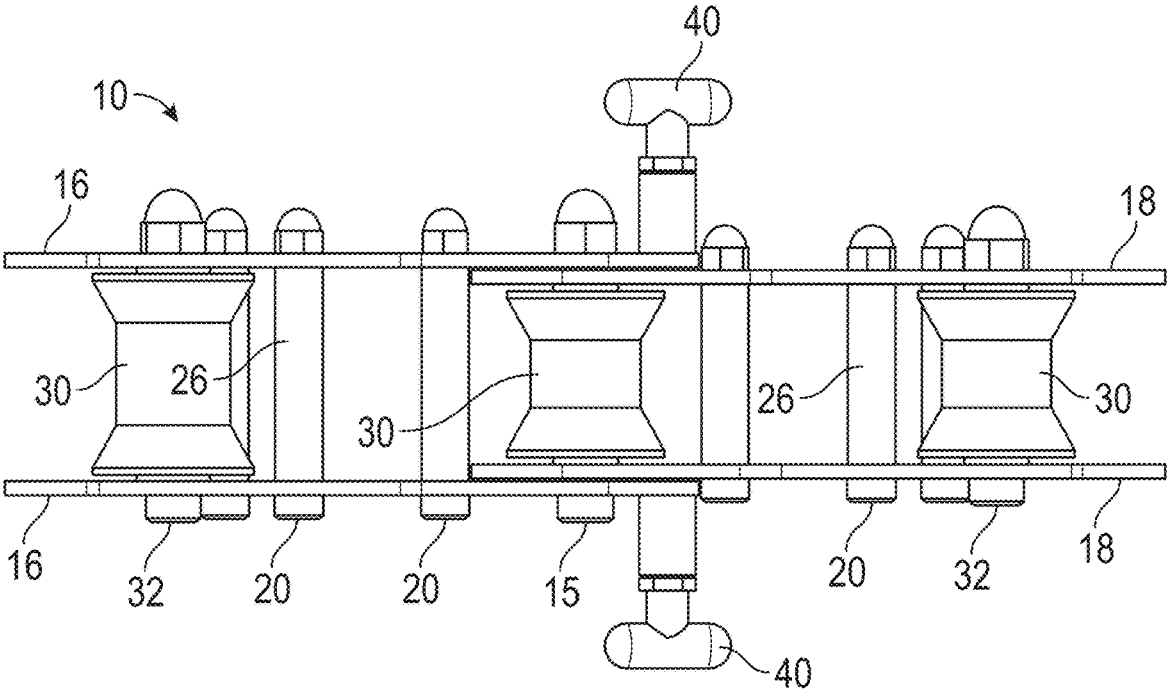
Figure 4C:
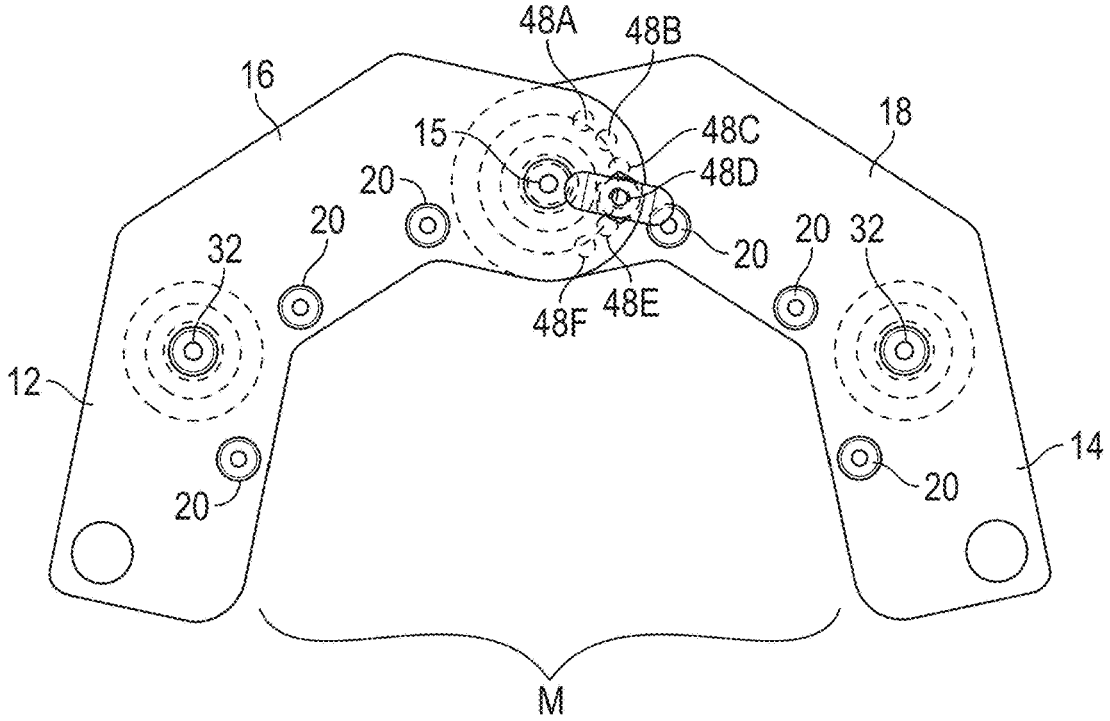
Figure 4D:
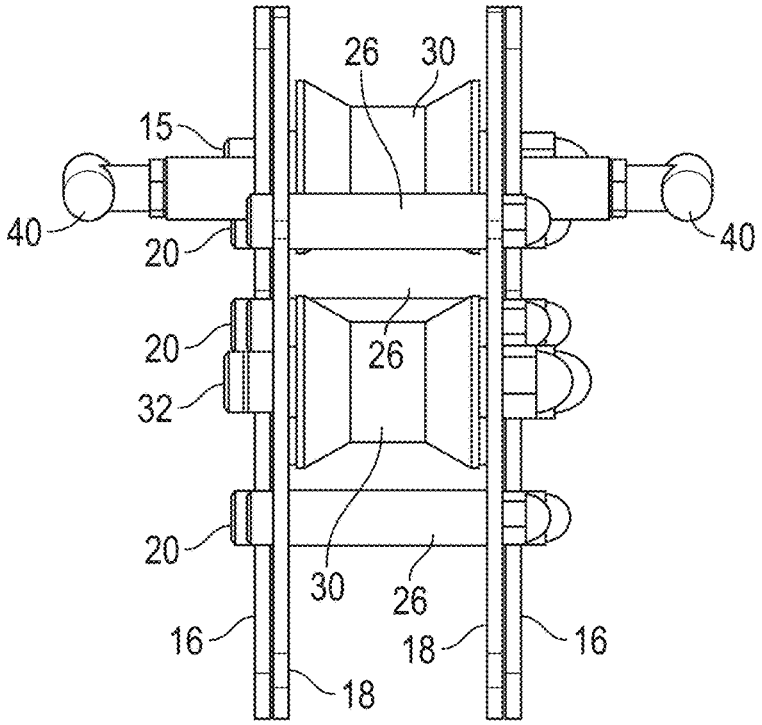
Figure 5A:
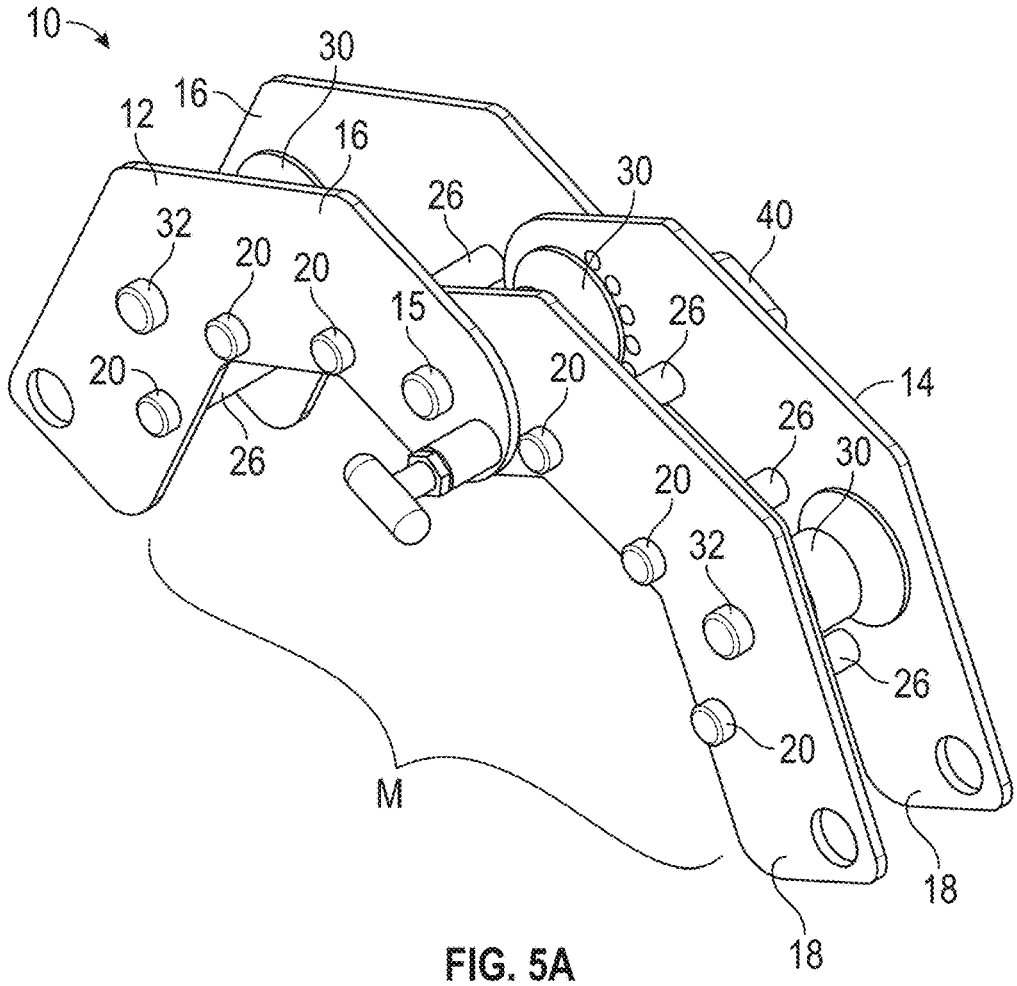
FIGS. 5A, B, C, and D, are a series of drawings similar to FIGS. 4A-4D, showing the system in a fifth position opened even more.
Figure 5B:
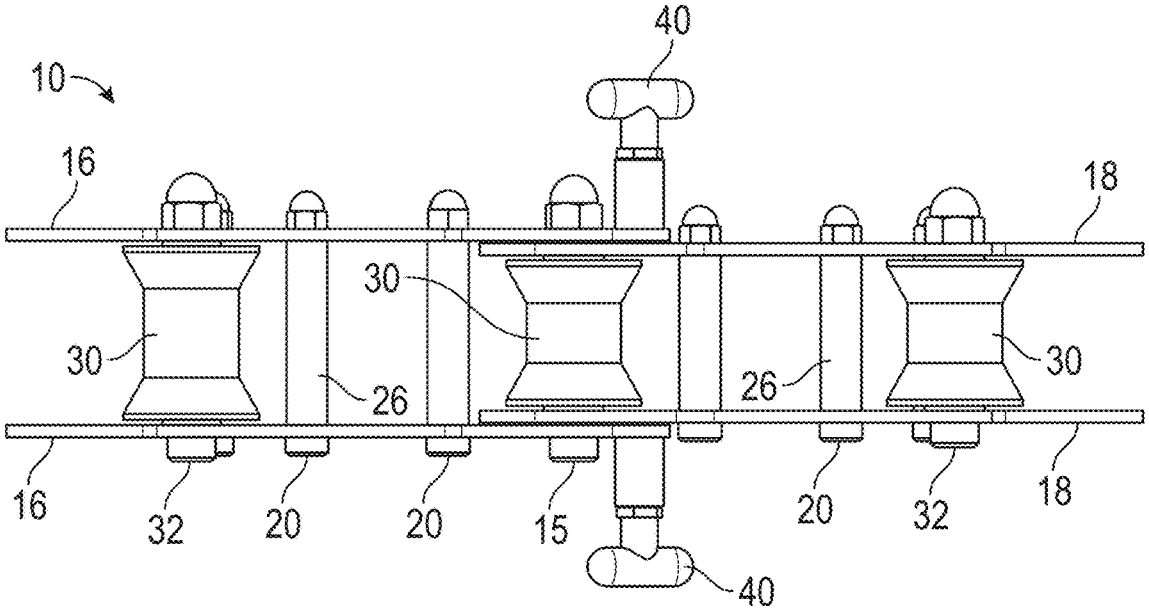
Figure 5C:
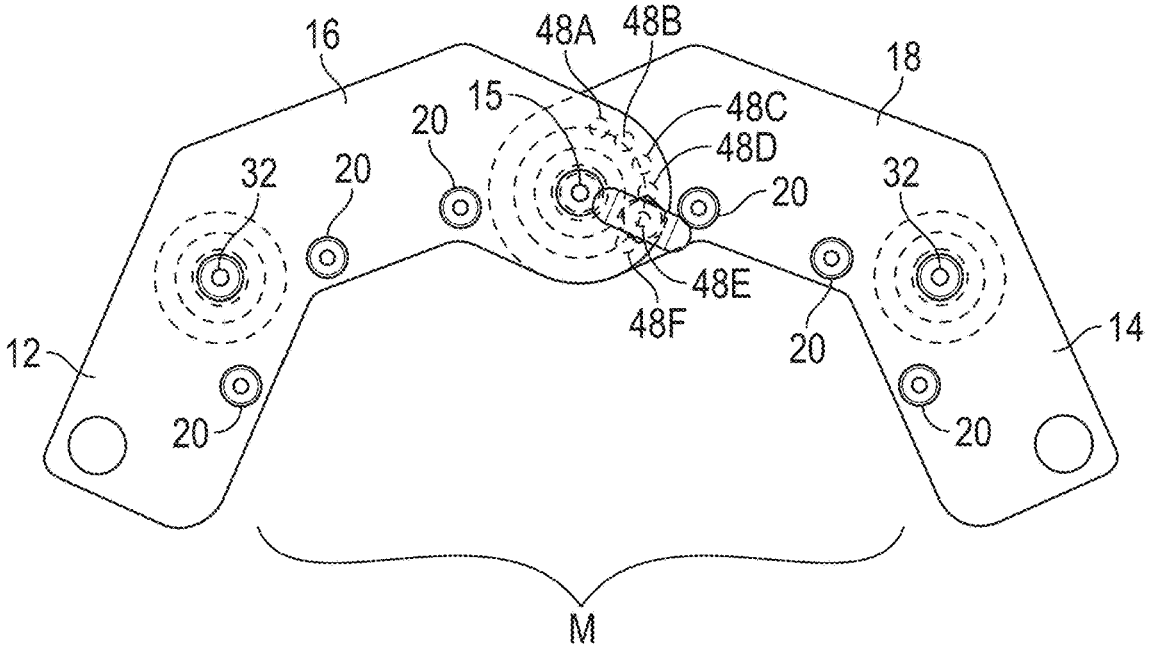
Figure 5D:
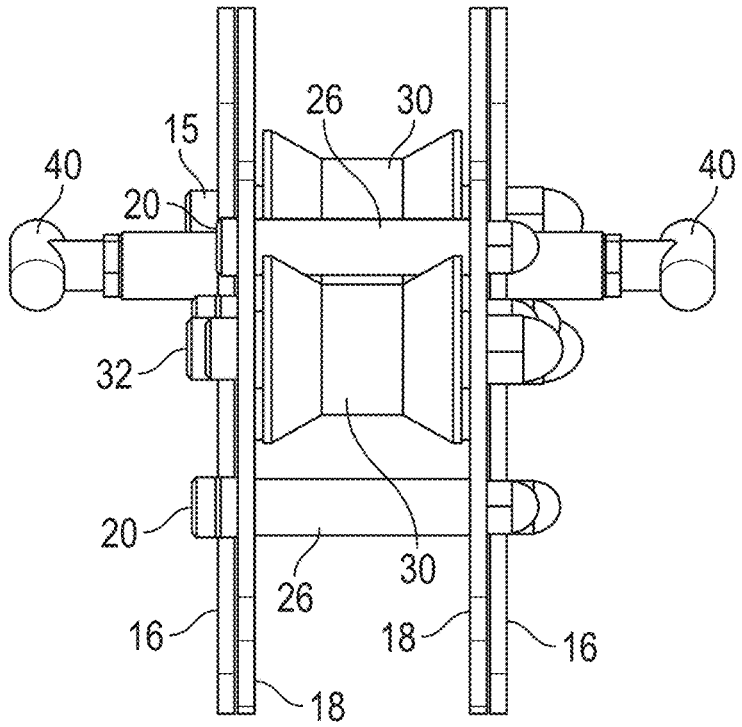
Figure 6A:
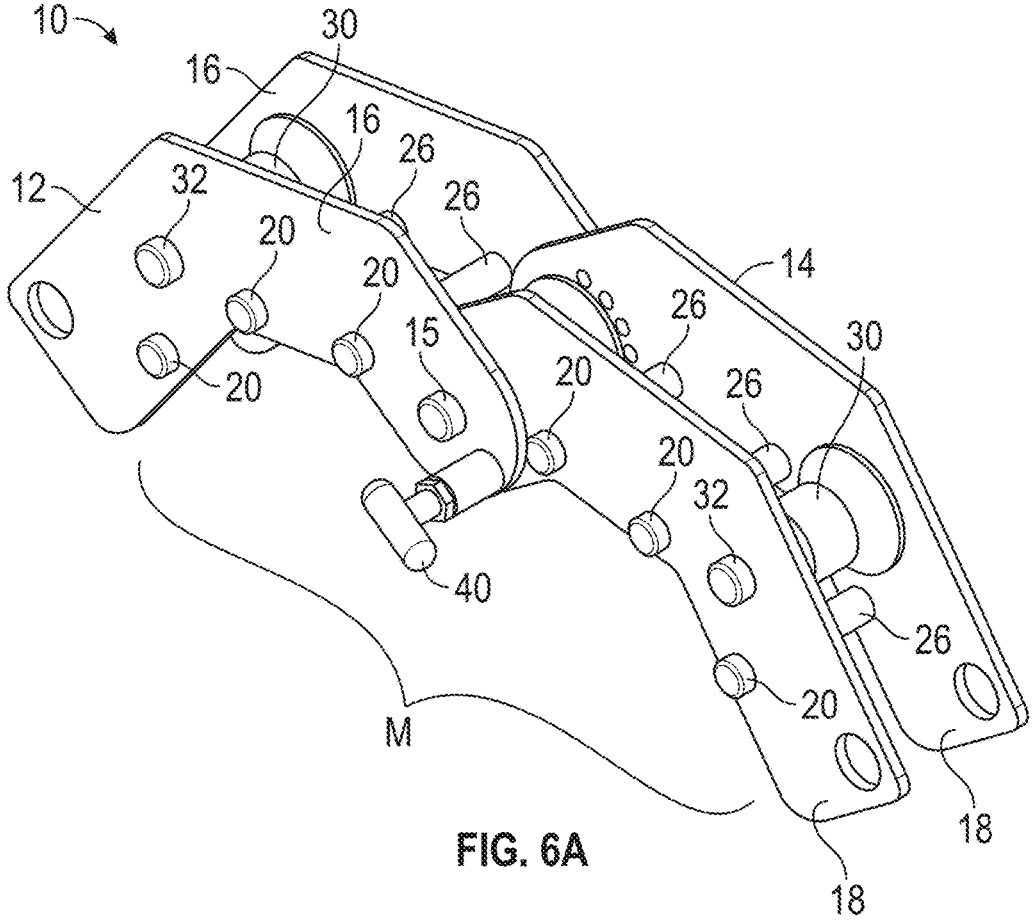
FIGS. 6A, B, C, and D, are a series of drawings similar to FIGS. 5A-5D, showing the system in a fully opened position.
Figure 6B:
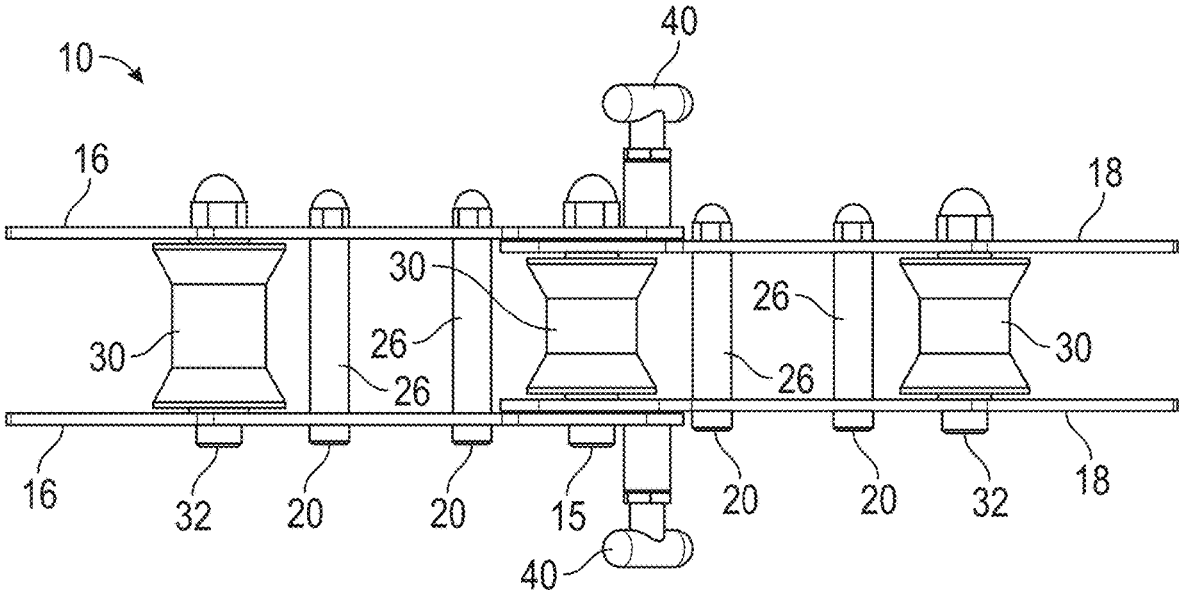
Figure 6C:
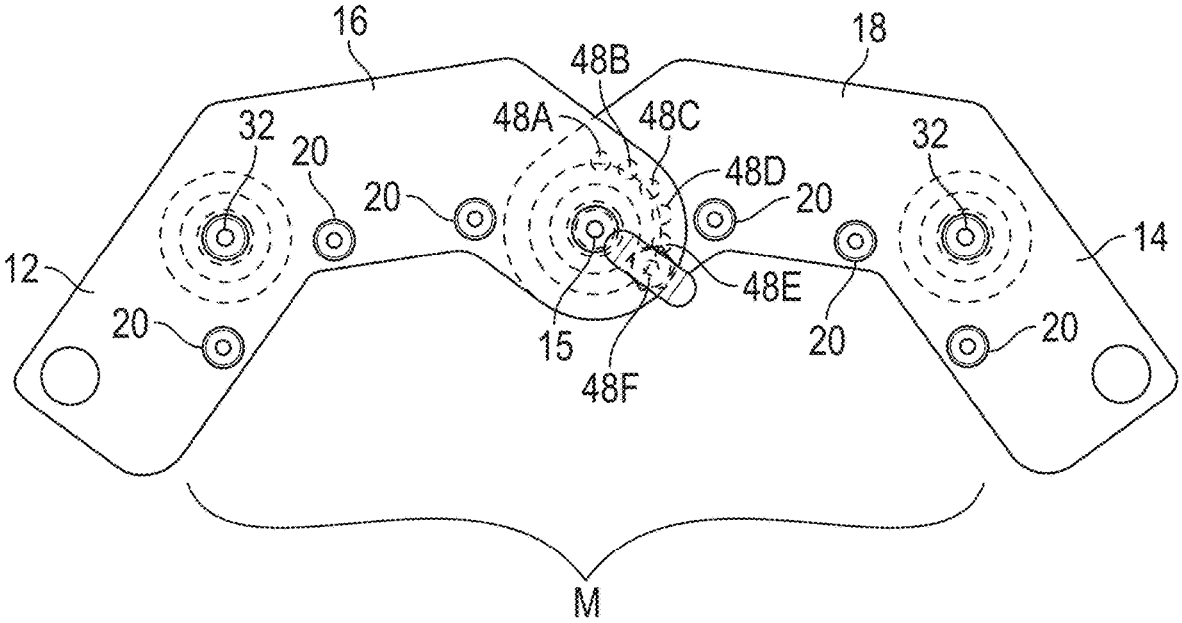
Figure 6D:
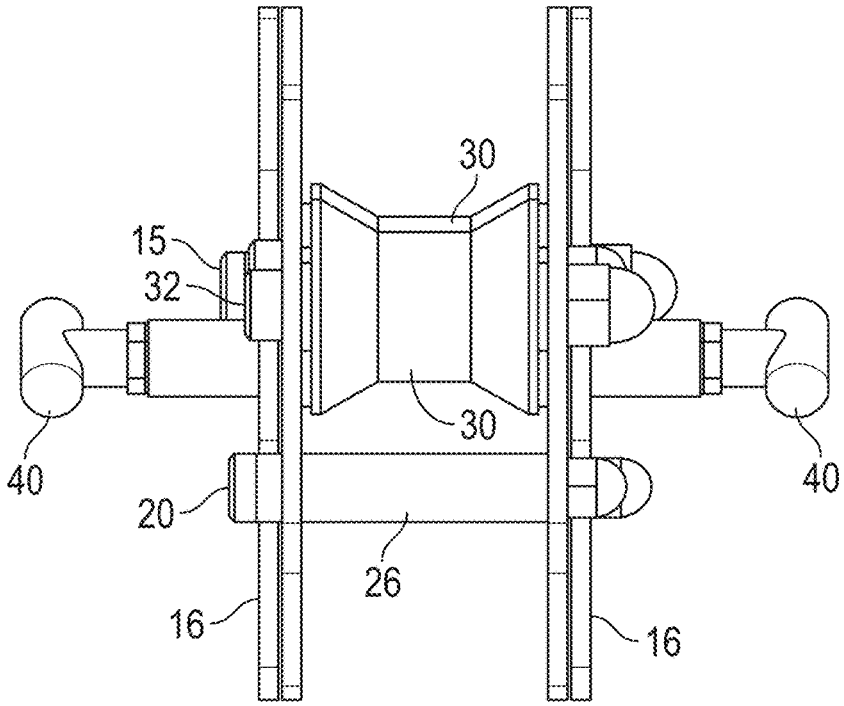
Figure 7:
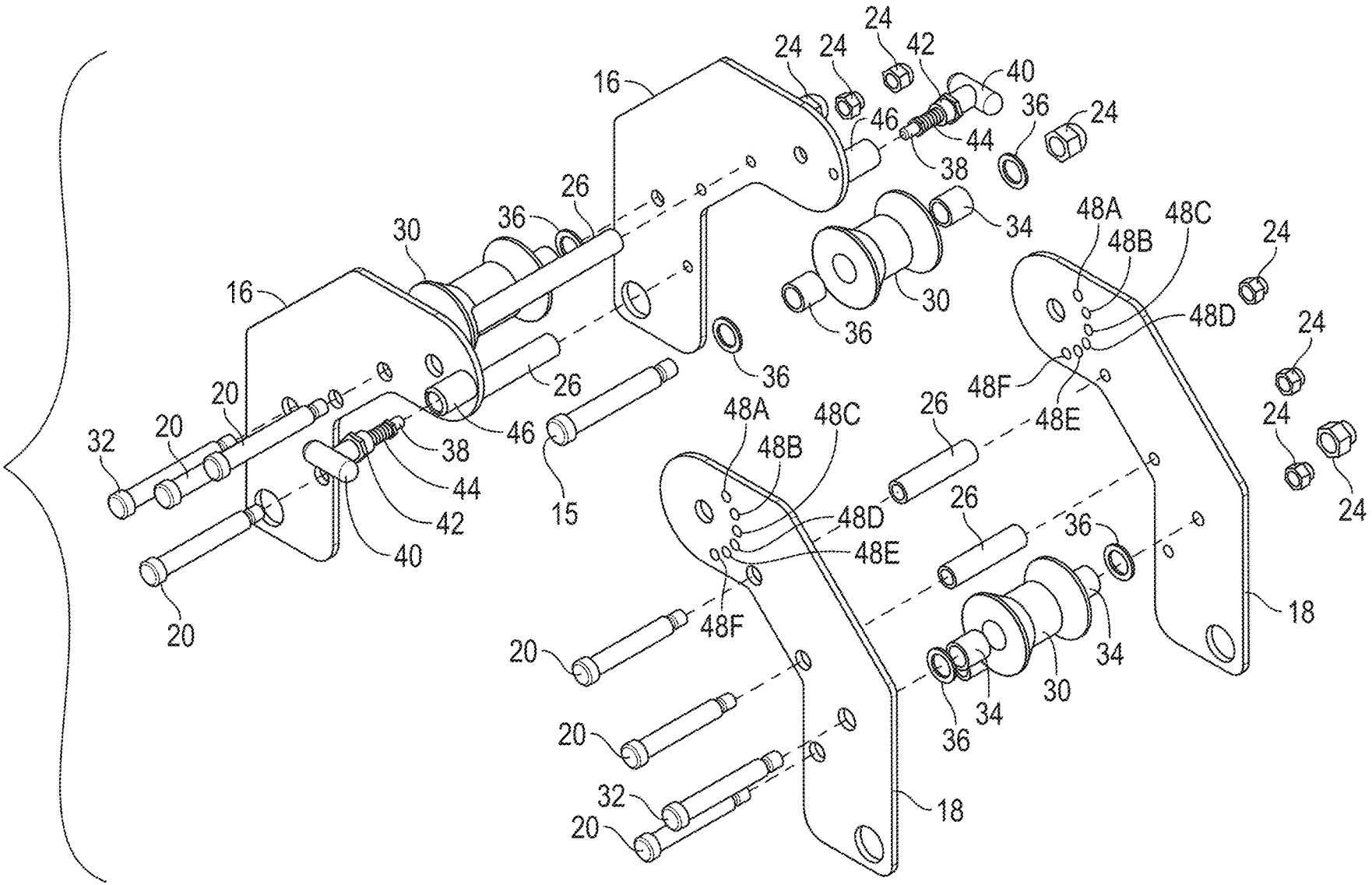
FIG. 7 is an exploded view showing the components of the adjustable roller system.

In use, an operator can pull outwardly on the handles 40 to disengage the pin bolts 38 from the selected hole 48A-F in the plates 16, 18, and thereby pivotally adjust the legs 12, 14. As shown in FIGS. 1A and 1C, this system can be closed around a relatively narrow diameter object, such as a hand rail, when the pin bolts 38 are positioned in the upper most adjustment holes 48A. In FIGS. 2A and 2C, the roller system is shown in the second position with the pin bolts 38 positioned in the holes 48B. FIGS. 3A-D, the pin bolts 38 are received in the holes 48C, such that the plates 12, 14, 16, 18 are in a middle position between fully closed and fully open. In FIGS. 4A-4D, the pin bolts 38 are received in hole 48D such that the plates are opened further apart from one another. In FIGS. 5A-5D, the pin bolts 38 are received in the holes 48E to further open the plates. In FIGS. 6A-6D, the pin bolts 38 are received in the holes 48F to fully open the plates relative to one another.

Thus, the adjustability of the roller system 10 allows the system to be used on various sized and shaped objects, with the rope always passing over the rollers 30, thereby eliminating the need for multiple roller systems having different, fixed sizes. While it may be possible to use only one pin bolt 38 on one side of the system, it is preferred to use dual pin bolts or locks for added security and safety. With the adjustable rope system 10 on the present invention, high angle rope rescues greater than 45 degrees can be safely and quickly accomplished, without risk of damage to the rope.

The rope roller system or assembly 10 is only one component for use in rope rescues and/or rope climbing, and allows the rope to safely pass over a rail, wall, or other object without excessive wear or damage.

The invention has been shown and described above with the preferred embodiments, and it is understood that many modifications, substitutions, and additions may be made which are within the intended spirit and scope of the invention. From the foregoing, it can be seen that the present invention accomplishes as least all of its stated objectives.

What is claimed is:

1. An adjustable roller system for use with ropes, comprising:

a first pair of spaced apart plates;

a second pair of spaced apart plates pivotally connected to the first pair of plates;

a plurality of rollers mounted between the spaced apart first and second pairs of plates;

the second pair of plates having a first plurality of adjustment holes; and a first pin mounted on the first pair of plates to be selectively positioned in one of the adjustment holes.

2. The adjustable roller systems of claim 1 wherein the first and second pairs of plates have outer ends defining a mouth, and the position of the pin allows the mouth to be moved between open and closed positions.

3. The adjustable roller system of claim 1 wherein the pin includes a handle.

4. The adjustable roller system of claim 1 wherein the pin is spring biased.

5. The adjustable roller system of claim 1 further comprising a second pin mounted on the first pair of plates on a side opposite the first pin for selective positioning in a second plurality of adjustment holes on the second pair of plates on a side opposite the first plurality of adjustment holes.

6. An adjustable rope guide, comprising:

a frame having opposite legs pivotally coupled at a mid-point;

rollers mounted on the legs over which a rope can move; and a pin for selective insertion into one of a plurality of holes in one of the legs to lock the legs in an adjustable angular position.

7. The rope guide of claim 6 wherein the legs have first and second pairs of spaced apart plates, and the rollers extend between the first pair of plates and between the second pair of plates.

8. The rope guide of claim 7 wherein the legs are hinged together for movement between open and closed positions.

9. The rope guide of claim 7 wherein the pin is spring biased into the holes.

10. The rope guide of claim 7 wherein the legs are curved.

11. An adjustable roller assembly for rope climbing and rope rescues, comprising:

left and right frame members pivotally connected together at inner ends and having outer ends spaced from one another;

the frame members being adjustable between a closed position wherein the outer ends are closely spaced and an open position wherein the out ends are widely spaced;

a lock pin extending through the frame members to lock the frame members in a selected pivoted position; and rollers on the frame members to support a rope for movement over the rollers; wherein the frame members include a plurality of holes for receipt of the lock pin.

12. The roller assembly of claim 11 wherein the lock pin has a spring to bias the pin into the holes.

13. The roller assembly of claim 11 wherein the lock pin includes a handle for pulling the pin from the frame members.

14. The roller assembly of claim 11 wherein the outer ends of the frame members define an adjustable mouth for positioning the assembly over an object.

* * * * *